United States Patent [19]

Higuchi

[11] Patent Number: 4,860,054

[45] Date of Patent: Aug. 22, 1989

[54] COPIER CONTROL SYSTEM

[75] Inventor: Masami Higuchi, Yokohama, Japan

[73] Assignee: Ricoh Company, Ltd., Tokyo, Japan

[21] Appl. No.: 161,094

[22] Filed: Feb. 26, 1988

[30] Foreign Application Priority Data

Feb. 28, 1987 [JP] Japan ..... 62-44131

[51] Int. Cl.[4] ..... G03G 15/00

[52] U.S. Cl. ..... 355/300; 355/210; 355/211

[58] Field of Search ..... 355/3 R, 3 DR, 3 BE, 355/14 R, 14 CU

[56] References Cited

U.S. PATENT DOCUMENTS 4,475,805 10/1984 Omi ..... 355/14 R
4,556,311 12/1985 Tagoku ..... 355/14 R
4,588,284 5/1986 Federico et al. ..... 355/14 R
4,589,763 5/1986 Fujiwara ..... 355/14 R
4,589,765 5/1986 Perun et al. ..... 355/14 R X
4,707,748 11/1987 Ohtsuka et al. ..... 355/3 DR X
4,731,638 3/1988 Cherian ..... 355/3 DR X

*Primary Examiner*—A. C. Prescott
*Attorney, Agent, or Firm*—Oblon, Spivak, McClelland, Maier & Neustatdt

[57] ABSTRACT

A control system for an electrophotographic copier of the type using a photoconductive element having a seam varies the position for starting counting timing pulses, which are adapted to control the operations of various units or electrical loads of the copier, in dependence upon the copy mode. The control system reduces the period of time necessary for the first copy to be produced by the copier.

3 Claims, 4 Drawing Sheets

COPIER CONTROL SYSTEM

BACKGROUND OF THE INVENTION

The present invention relates to a system for controlling an electrophotographic copier and, more particularly, to a system for controlling the operations of various units of an electrophotographic copier of the type using a photoconductive element having a seam.

An electrophotographic copier includes a photoconductive element in the form of a drum or a belt. Arranged around the photoconductive element are various units such as a charging unit, an exposing unit, a developing unit, a transferring unit, a separating unit and a cleaning unit. Further, a roller drive clutche, a pawl solenoid adapted for selectively discharging one-sided and two-sided copies and other various elements are located along a path for transporting a paper sheet on which an image is printed. All these units and elements may be regarded as electrical loads of the copier. With an electrophotographic copier wherein the operations of such electrical loads are controlled on the basis of the number of timing pulses counted, a prerequisite is that a reference position for counting the timing pulses be defined preceding one of those loads which is expected to operate earliest. A problem heretofore pointed out is that the reference position is unchangeable even if that particular load to operate earliest is not necessary as in certain copy modes, resulting in an increase in the period of time necessary for copying.

SUMMARY OF THE INVENTION

It is, therefore, an object of the present invention to provide a copier control system capable of reducing the period of time which is necessary for the first copy to be produced by a copier.

It is another object of the present invention to provide a generally improved copier control system.

A system for controlling a copier having independent units which constitute a plurality of electrical loads for forming an image on a photoconductive element and recording the image on a paper sheet of the present invention comprises a pulse generating circuit for generating timing pulses, a counting circuit for counting the timing pulses, and a control circuit for controlling operations of the electrical loads on the basis of the number of timing pulses counted by the counting circuit.

The counting circuit starts counting the timing pulses at any of a plurality of points, and the control circuit selects one of the plurality of points for starting counting the timing pulses depending upon a copy mode.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
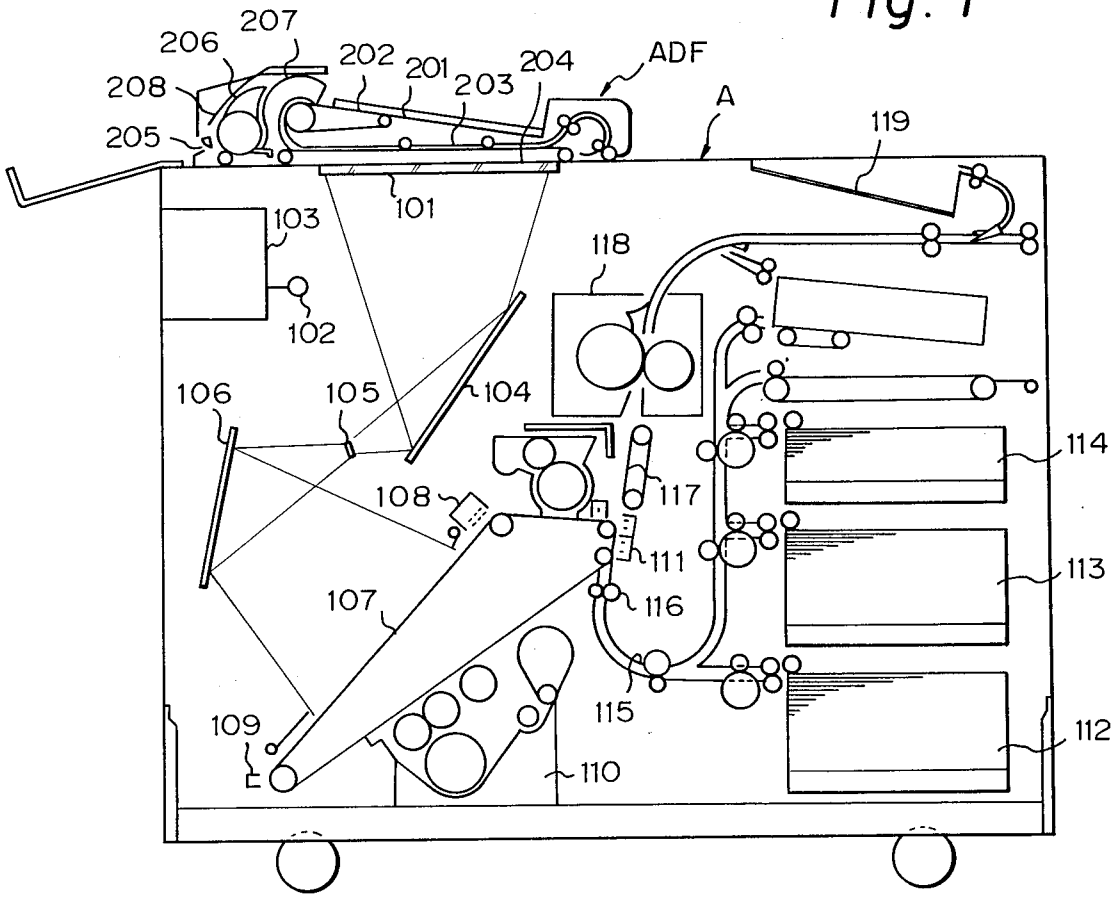
FIG. 1 is a schematic view showing a copier to which the present invention is applied.

Referring to FIG. 1 of the drawings, a copier to which the present invention is applied is shown and generally made up of a copier body A and an automatic document feeder ADF. An operation board is provided on the copier body A and manually operable to set up any desired copy mode. A print button positioned on the operation board is accessible to start a copying operation in the particular copy mode selected. On the other hand, the automatic document feeder ADF includes a document tray 201 on which documents may be loaded. The documents on the tray 201 are fed one at a time by a belt 202 toward a glass platen 101 along a transport path 203. The document reached the glass platen 101 is illuminated over its entire surface by a flash lamp 102. A power source 103 associated with the flash lamp 102 is supplied with a charge beforehand from a control system, which will be described, so as to energize the flash lamp 102 at a predetermined timing.

Light reflected by the document on the glass platen 101 is routed through a first mirror 104, a through lens 105 and a second mirror 106 to expose a photoconductive belt 107 imagewise. Since a uniform charge has been deposited on the belt 107 by a charger 108, a latent image is electrostatically formed on the belt 107 by such exposure. An eraser 109 is operated to remove the charge from needless portions of the latent image on the belt 107 and, then, a developing unit 110 is operated to develop the latent image. The resulting toner image on the belt 107 is transported to a transfer station where a transfer charger 111 is located. A paper sheet is fed from any of paper trays 112, 113 and 114 toward a register roller 116 by way of a transport path 115 and, timed to the toner image on the belt 107, driven to the transfer station by the register roller 116. Consequently, the toner image is transferred from the belt 107 to the paper sheet. Thereafter, the paper sheet with the toner image is transported by a belt 117 to a fixing unit 118 and, therefrom, to a copy tray 119.

After the illumination, the document on the glass platen 101 is returned to the document tray 201 by a belt 204 and, then, by a discharge roller 206 which is reversible. Specifically, when it is desired to discharge the document face up as in the initial position on the tray 201, the rotation of the discharge roller 206 is reversed after the trailing edge of the document has moved past a selector pawl 205. In this case, the document is driven out to the tray 201 by way of a forward transport path 207. Conversely, to discharge the document upside down, the discharge roller 206 is driven in the forward direction causing the document to follow a reverse transport path 208 toward the tray 201.

Figure 2:
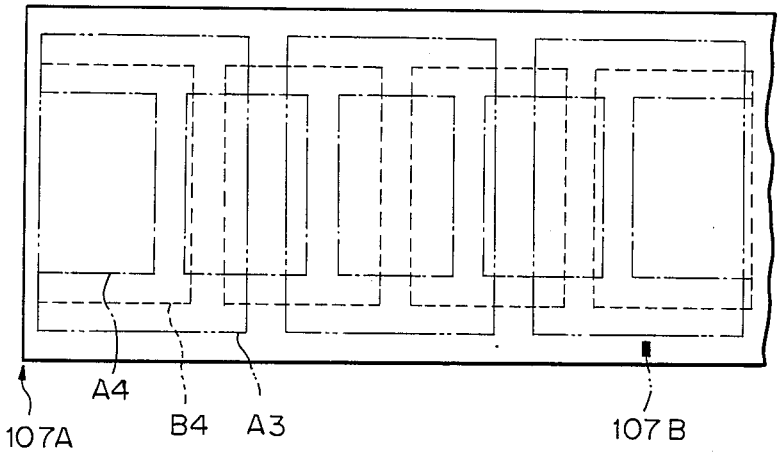
FIG. 2 is a fragmentary view of a photoconductive belt included in the copier of FIG. 1, schematically showing exemplary image forming regions which may be defined on the belt.

Since the photoconductive belt 107 has a seam, image forming regions are defined on the belt 107 at equal distances for each of various sheet sizes, avoiding the seam. FIG. 2 shows the belt 107 which is cut along its seam and developed. In the example shown in FIG. 2, five A4 segments or image forming regions are defined on the belt 107 at equal distances, as represented by dash-and-dot lines; four B4 segments are defined at equal distances, as represented by dashed lines; and three A3 segments are defined at equal distances, as represented by dash-and-dots lines.

Figure 3:
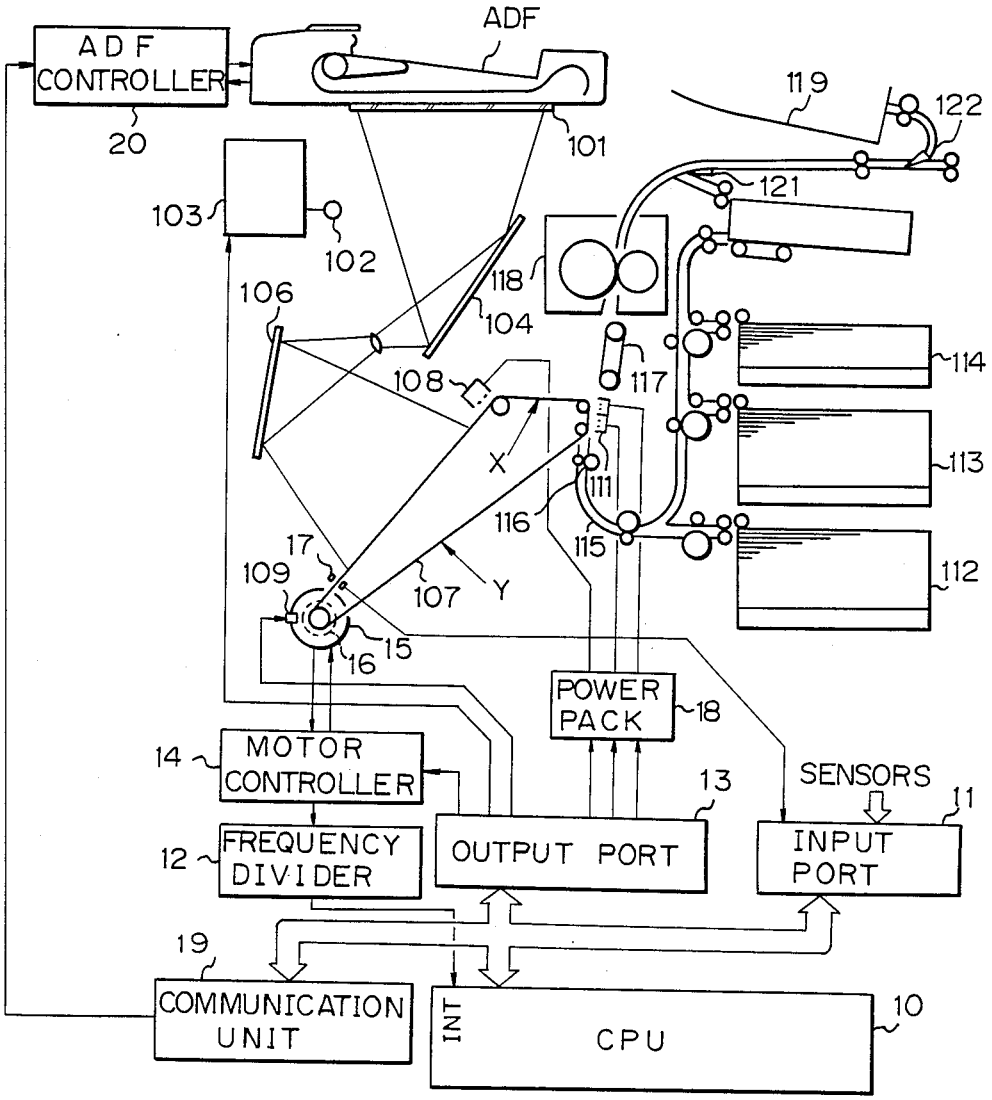
FIG. 3 is a schematic view showing a control system in accordance with the present invention.

Referring to FIG. 3, there is shown a control system built in the copier body A for forming an image on the photoconductive belt 107 and, then, transferring it to a paper sheet which is fed from any of the trays 112, 113 and 114. The operation of the control system will hereinafter be described with reference to FIG. 3.

To avoid the seam of the photoconductive belt 107 as stated above, it is necessary that image forming regions be defined on the belt 107 before images are formed. In the illustrative embodiment, this is implemented with a synchronizing mark 107B which is positioned at one marginal edge of the belt 107 and at a predetermined distance from the seam 107A. As shown in FIG. 3, a mark sensor 17 is provided for sensing the synchronizing mark 107B. To define image forming regions on the belt 107, the belt 107 has to be driven to sense the mark 107B. For this purpose, a drive signal from an output port 13 is applied to a motor controller 14 which then drives a belt drive motor 15. This motor 15 may be implemented with a DC motor by way of example. An encoder 16 is mounted on the motor 15 so as to produce pulses the number of which is proportional to the distance of movement of the belt 107. The pulse signal outputted by the encoder 16 is fed to the motor controller 14 to drive the motor 15 at a constant speed. Further, the pulses are routed to a frequency divider 12 to be thereby divided to a predetermined ratio. The output of the frequency divider 12 is applied to and counted by a central processing unit (CPU) 10. Since this signal is proportional to the amount of movement of the belt 107, image forming regions are determined based on the count.

How the A4 segments are determined will be described in detail by way of example. Assume that the number of pulses which appear during one full rotation of the belt 107 is $n_0$. Specifically, the number of pulses $n_0$ is representative of the interval between the time at which the synchronizing mark 107B on the belt 107 is sensed by the mark sensor 17 and applied to an input port 11 as a mark signal and the time when it is sensed next. It follows that a value produced by dividing the number of pulses $n_0$ by five, i.e., the number of A4 segments is representative of the width of each A4 segment or image forming region. Hence, the pulse number which is indicative of the leading edge of any of the A4 segments is expressed as:

$$a_0 + n \cdot \frac{n_0}{5} \quad (n = 0, 1, 2, 3, 4)$$

where $a_0$ is the number of pulses which is representative of the distance as measured from the seam 107A of the belt 107 to the leading edge of the segment.

The copying operation is as follows. As the leading edge of any A4 segment reaches a point X, FIG. 3, a sequential operation is started with an exclusive counter for sequence control enabled. This counter is incremented by pulses outputted by the frequency divider 12 and continuously incremented till the end of sequence without being cleared. When the counter reaches a count "CNT1," a signal is fed from the output port 13 to a power pack 18 resulting that the charger 108 is energized to uniformly charge the belt 107. Thereafter, when the count is incremented to "CNT2," a charge start signal is fed from the output port 13 to the power source 103 which is associated with the flash lamp 102 and, therefore, a charge for turning on the lamp 102 is stored in a capacitor of the power source 103. When a flash signal is applied to the power source 103, the flash lamp 102 is turned on to illuminate a document which is loaded on the glass platen 101 while, at the same time, the belt 107 is exposed imagewise. The flash signal mentioned above is produced when the counter is incremented to a count "CNT3". As the belt 107 is further rotated until the leading edge of the image provided thereon reaches the position of the eraser 109 ("CNT4"), the eraser 109 is turned off to allow the charge to remain only in that part which corresponds to the document image.

The latent image is developed by the developing unit 110, FIG. 1, and then transferred to a paper sheet which is fed from one of the trays 112, 113 and 114. The timing at which a paper sheet begins to be fed depends upon the tray so that the paper sheet may be timed to the image provided on the belt 107. Specifically, a paper sheet in the lower tray 112 begins to be fed at a count "CNT-LOW," a paper sheet in the middle tray 113 at a count "CNT-MID," and a paper sheet in the upper tray 114 at a count "CNT-HIGH". The paper sheet to which the toner image is transferred from the belt 107 is conveyed by the belt 117 to the fixing unit 118. Actuated at a count "CNT5," a two-side selector pawl 121 is switched to a two-side tray side in the case of a two-sided copy mode and to a discharge side if otherwise. A discharge selector pawl 122 is operated at a count "CNT6" to cause the paper sheet to be routed to either one of the tray 119 and peripheral equipment which is associated with the copier. The sequential operation terminates with the discharge of the paper sheet.

The sequential operation described above is performed with a cover plate or presser plate used. In the event when the automatic document feeder ADF is used, it has to set a document on the glass platen 101 before the flash lamp 102 is turned on. Since the period of time needed for the automatic document feeder ADF to load a document so is longer than the interval between the movement of the leading edge of a segment past a point Y, i.e., the start of the sequential operation and the illumination of the document by the flash lamp 102, the sequential operation with the document feeder ADF is started at the point Y. Specifically, the sequential operation begins when the leading edge of a segment is brought to the point Y and, when a count "CNT-DF" is reached, a command is fed to the controller 20 via a communicating unit 19 to move a document.

Figure 4:
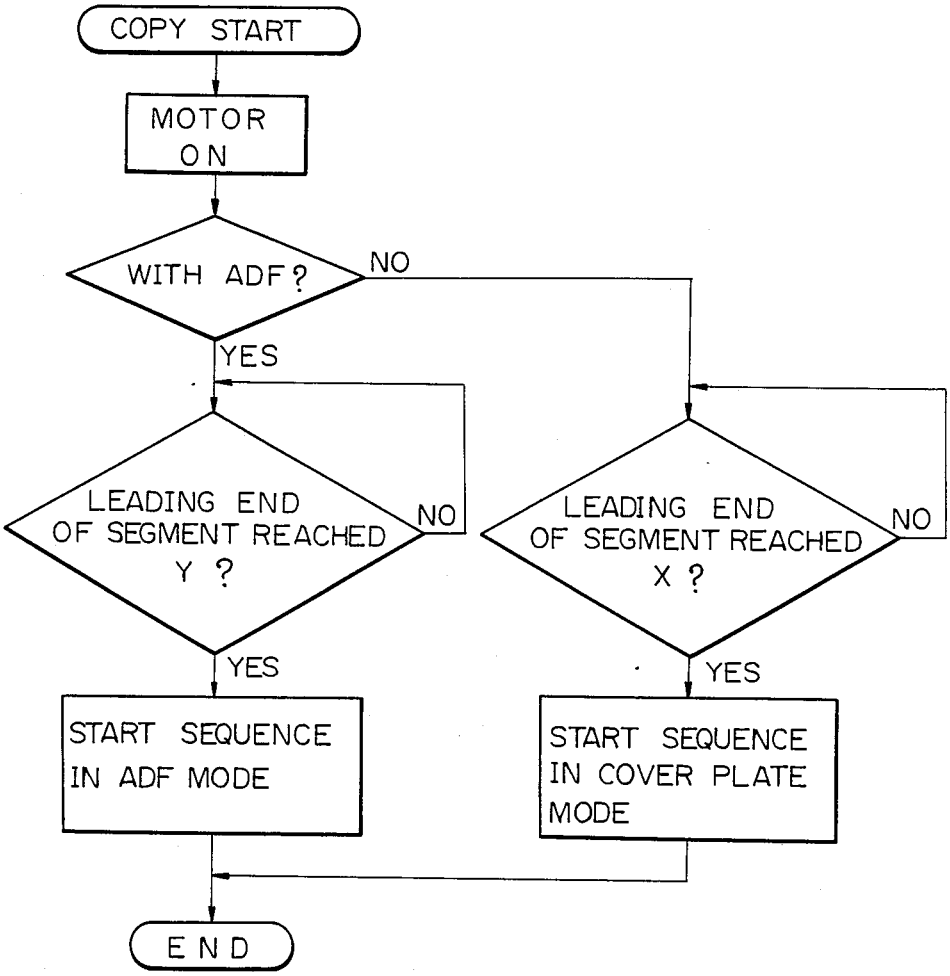
FIG. 4 is a flowchart demonstrating the operation of the control system as shown in FIG. 3.

FIG. 4 is a flowchart demonstrating the operating described above.

In summary, it will be seen that the present invention provides a copier control system which reduces the period of time necessary for the first copy to be produced because it varies the point for starting counting timing pulses which are adapted to control the operations of various units, or electrical loads, of a copier in dependence upon the copy mode.

Various modifications will become possible for those skilled in the art after receiving the teachings of the present disclosure without departing from the scope thereof.

What is claimed is:

1. A system for controlling a copier having independent units which constitute a plurality of electrical loads for forming an image on a photoconductive element and recording said image on a paper sheet, comprising:

pulse generating means for generating timing pulses;

counting means for counting said timing pulses; and control means for controlling operations of said electrical loads on the basis of the number of timing pulses counted by said counting means;

said counting means starting counting said timing pulses at any of a plurality of points, said control means selecting one of said plurality of points for starting counting said timing pulses depending upon a copy mode.

2. A system as claimed in claim 1, wherein said photoconductive element comprises a photoconductive belt having a seam.

3. A system as claimed in claim 1, wherein said photoconductive element comprises a photoconductive drum having a seam.

* * * * *